US005178175A

United States Patent [19]

Lin

[11] Patent Number: 5,178,175

[45] Date of Patent: Jan. 12, 1993

[54] REMOVABLE RAIN WATER COLLECTING DEVICE FOR UMBRELLAS

[76] Inventor: Ching P. Lin, No. 34-18, Chang Chun St., Ping Tung City, Pink Tung Hsien, Taiwan

[21] Appl. No.: 894,083

[22] Filed: Jun. 5, 1992

[51] Int. Cl.[5] ..... A45B 25/28

[52] U.S. Cl. ..... 135/48; 135/15.1

[58] Field of Search ..... 135/48, 15.1, 16, 33.6

[56] References Cited

U.S. PATENT DOCUMENTS

| | | | |
|---|---|---|---|
| 330,789 | 11/1885 | Jones | 135/48 |
| 423,990 | 3/1890 | Dattlebaum | 135/48 |
| 474,616 | 5/1892 | Tyson | 135/48 |
| 2,427,188 | 9/1947 | Bossart | 135/48 |
| 2,808,066 | 10/1957 | Pugliese | 135/48 |
| 3,809,107 | 5/1974 | Liu | 135/48 |
| 4,703,768 | 11/1987 | Lee | 135/48 |
| 5,111,835 | 5/1992 | Lin | 135/48 X |

FOREIGN PATENT DOCUMENTS

| | | | |
|---|---|---|---|
| 0051166 | 4/1977 | Japan | 135/48 |

*Primary Examiner*—Richard E. Chilcot, Jr.

*Assistant Examiner*—Lan Mai

*Attorney, Agent, or Firm*—Fitch, Even, Tabin & Flannery

[57] ABSTRACT

A rain water collecting device for an umbrella includes a reservoir (6) with a closed end and an open end. A diaphragm (10) is mounted in the reservoir (6) adjacent to the open end to separate the reservoir (6) into a first compartment (62) and a second compartment (64). A receiving member (5) is mounted in the center of the diaphragm (10) and extends into the first compartment (62) for removably receiving a tip of the umbrella. A first coil tube (8) mounted in the first compartment (62) has a inlet (3) located at the diaphragm (5) and an outlet (4) in the first compartment (62). A second coil tube (9) mounted in the second compartment (64) has an inlet (1) located at the diaphragm (5) and an outlet (2) in the second compartment (64). When the umbrella is folded after use, the rain water is guided into the first compartment (62) via the first coil tube (8). For draining the rain water collected in the reservoir (6), the umbrella together with the reservoir (6) is turned upside down so as to allow the rain water in the first compartment (6) to drain outside via the second coil tube (9).

2 Claims, 4 Drawing Sheets

REMOVABLE RAIN WATER COLLECTING DEVICE FOR UMBRELLAS

BACKGROUND OF THE INVENTION

The present invention relates to a device which can be removably attached to an umbrella for collecting rain water after folding the umbrella to prevent rain water remaining on the cloth of the umbrella from falling to the floor and wetting the floor or carpet.

Umbrellas are useful during rainy days. However, of particular concern to users is the fact that rain water remaining on the cloth of umbrellas can wet the floor and/or carpets. A rain water collecting means has been proposed to obviate this problem. However, another problem arises since such a proposed means utilizes a sponge to absorb rain water which is apt to provide an environment for bacterial growth.

Therefore, there has been a long and unfulfilled need for a rain water collecting device for umbrellas to collect rain water remaining on the umbrella's cloth and to obviate the above-mentioned problems.

SUMMARY OF THE THE INVENTION

A rain water collecting device for an umbrella in accordance with the present invention includes a reservoir with a closed end and an open end. A diaphragm is mounted in the reservoir adjacent to the open end to separate the reservoir means into a first compartment and a second compartment. A receiving member is mounted in the center of the diaphragm and extends into the first compartment for removably receiving a tip of the umbrella. A first coil tube mounted in the first compartment has an inlet located at the diaphragm and an outlet in the first compartment. A second coil tube mounted in the second compartment has an inlet located at the diaphragm and an outlet in the second compartment.

The rain water collecting device is applied to the umbrella with the tip of the umbrella securely received in the receiving means of the device. When the umbrella is folded after use, the rain water remaining on the cloth of the umbrella drains into the first compartment via the first coil tube. For draining the rain water collected in the reservoir, the umbrella together with the reservoir are turned upside down so as to allow the rain water in the first compartment to drain outside via the second coil tube.

Other advantages and novel features of the invention will become more apparent from the following detailed description when taken in conjunction with the accompanying drawings.

BRIEFF DESCRIPTION OF THE DRAWINGS

DETAILED DESCRIPTION OF THE PREFERRED EMBODIMENTS

Figure 1:
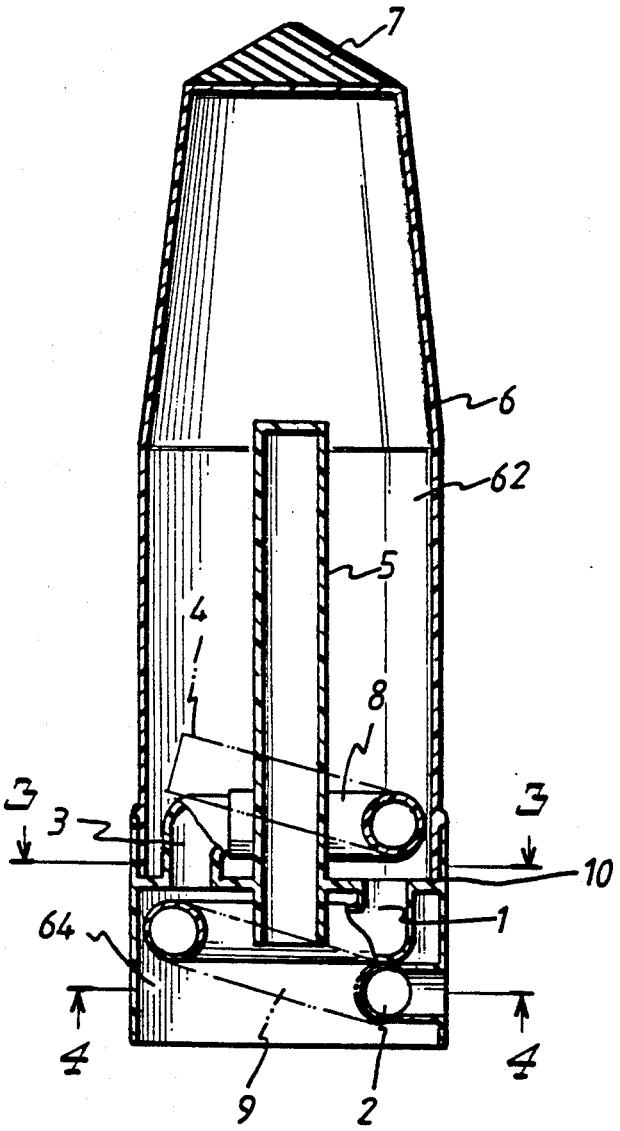
FIG. 1 is a longitudinal cross-sectional view of a rain water collecting device for umbrellas in accordance with the present invention.
Figure 2:
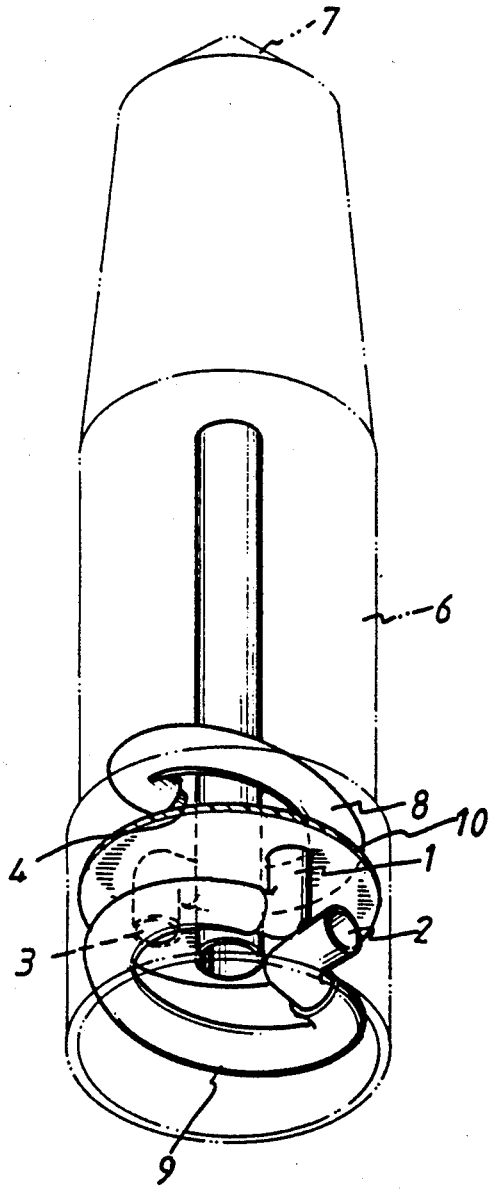
FIG. 2 is a perspective view of the rain water collecting device for umbrellas.
Figure 4:
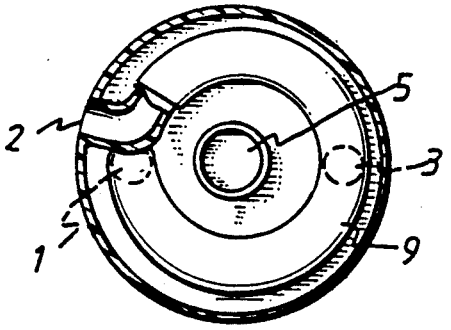
FIG. 4 is a cross-sectional view taken along line 4—4 in FIG. 1.
Figure 3:
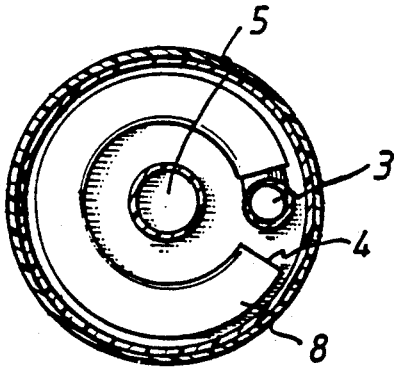
FIG. 3 is a cross-sectional view taken along line 3—3 in FIG. 1.

Referring to FIGS. 1 through 4, a rain water collecting device for an umbrella in accordance with the present invention generally includes a reservoir means 6 with a closed end and an open end. A diaphragm 10 is mounted in the reservoir means 6 adjacent to the open end to separate the reservoir means 6 into a first compartment 62 and a second compartment 64. A receiving member 5 is mounted in the center of the diaphragm 10 and extends into the first compartment 62 for removably receiving a tip of the umbrella. A first coil tube 8 mounted in the first compartment 62 has an inlet 3 located at the diaphragm 5 and an outlet 4 in the first compartment 62. A second coil tube 9 mounted in the second compartment 64 has an inlet 1 located at the diaphragm 5 and an outlet 2 in the second compartment 64.

Figure 5:
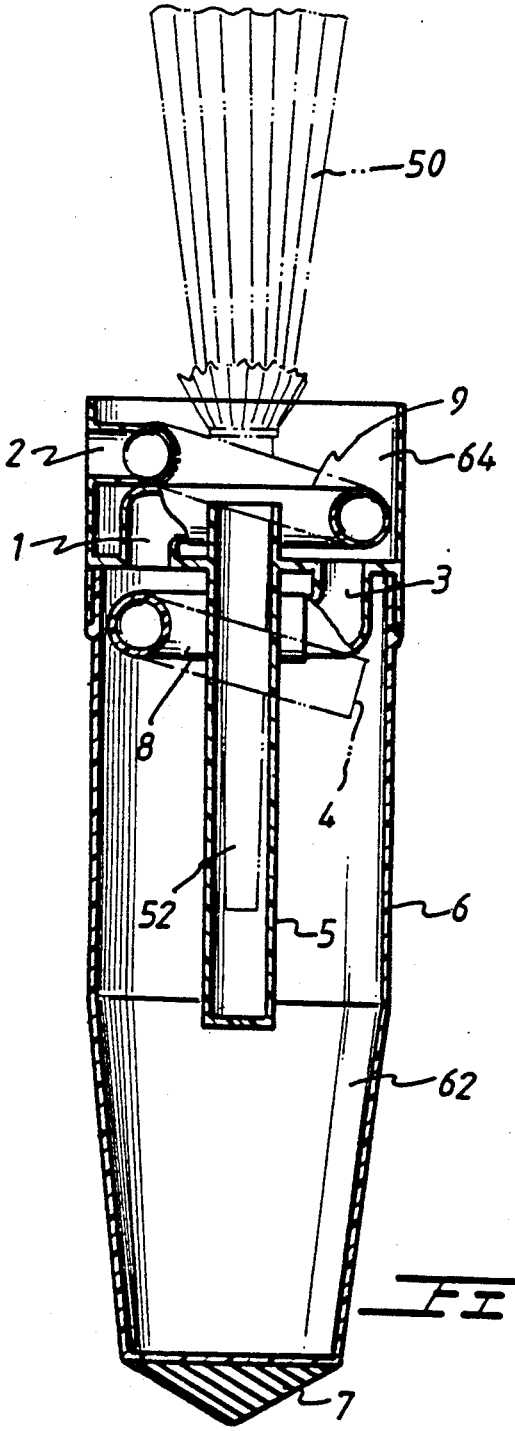
FIG. 5 is a partial cross-sectional view showing application of the rain water collecting device on an umbrella.

FIG. 5 shows an application of the invention. An umbrella 50 is inserted into the rain water collecting device with the tip 52 of the umbrella 50 securely received in the receiving means 5 of the rain water collecting device. When the umbrella 50 is folded after use, the rain water remaining on the cloth of the umbrella 50 drains into the first compartment 62 via the first coil tube 8. For draining the rain water collected in the reservoir 6, the umbrella 50 together with the reservoir 6 are turned upside down so as to allow the rain water in the first compartment 6 to drain outside (i.e., the second compartment) via the second coil tube 9. Alternatively, the rain water collecting device can be detached to proceed with the drainage. The first coil tube 8 acts as a passage for air when draining the rain water in the first compartment 62, thereby providing a pressure balance between the first compartment and the outside environment, so that the rain water in the first compartment 62 can be drained without difficulty.

Incidentally, a pad means 7 can be provided around the closed end of the reservoir means 6, protecting the closed end of the reservoir means 6.

Although the invention has been explained in relation to its preferred embodiment, it is to be understood that many other possible modifications and variations can be made without departing from the spirit and scope of the invention as hereinafter claimed.

I claim:

1. A rain water collecting device for an umbrella comprising:

a reservoir means (6) with a closed end and an open end;

a diaphragm (10) mounted in said reservoir means (6) adjacent to said open end to separate said reservoir means (6) into a first compartment (62) and a second compartment (64);

a receiving means (5) mounted in the center of said diaphragm (10) and extending into said first compartment (62) for receiving a tip of the umbrella;

a first coil tube (8) mounted in said first compartment (62) for guiding rain water remaining on the umbrella after folding into said first compartment (62), having an inlet (3) located at said diaphragm (5) and an outlet (4) in said first compartment (62); and a second coil tube (9) mounted in said second compartment (64) for draining collected rain water in said first compartment (62), having an inlet (1) located at said diaphragm (5) and an outlet (2) in said second compartment (64).

2. The rain water collecting device as claimed in claim 1, further comprising a pad means (7) mounted around said closed end of said reservoir means (6).

* * * * *

UNITED STATES PATENT AND TRADEMARK OFFICE

CERTIFICATE OF CORRECTION

PATENT NO. : 5,178,175

DATED : January 12, 1993

INVENTOR(S) : Ching Ping LIN

It is certified that error appears in the above-identified patent and that said Letters Patent is hereby corrected as shown below:

IN THE ABSTRACT:

Item [57] line 10, change "a" to read --an--

Signed and Sealed this

Seventh Day of December, 1993

*Attest:*

*Attesting Officer*

Bruce Lehman

BRUCE LEHMAN

*Commissioner of Patents and Trademarks*